US008400122B2

(12) United States Patent
North et al.

(10) Patent No.: US 8,400,122 B2
(45) Date of Patent: Mar. 19, 2013

(54) SELECTIVELY ACTIVATED THREE-STATE CHARGE PUMP

(75) Inventors: Brian Ben North, Santa Clara, CA (US); Cary L. Delano, Los Altos, CA (US)

(73) Assignee: Fairchild Semiconductor Corporation, San Jose, CA (US)

( * ) Notice: Subject to any disclaimer, the term of this patent is extended or adjusted under 35 U.S.C. 154(b) by 487 days.

(21) Appl. No.: 12/644,646

(22) Filed: Dec. 22, 2009

(65) Prior Publication Data

US 2011/0148385 A1 Jun. 23, 2011

(51) Int. Cl.
*G05F 1/59* (2006.01)

(52) U.S. Cl. ..... 323/268; 323/303; 363/63

(58) Field of Classification Search ..... 363/63, 363/62; 323/271, 268; 307/82
See application file for complete search history.

(56) References Cited

U.S. PATENT DOCUMENTS

| | | | | |
|---|---|---|---|---|
| 5,463,542 | A * | 10/1995 | Okamoto | 363/60 |
| 6,438,005 | B1 * | 8/2002 | Walter | 363/60 |
| 2002/0109488 | A1 * | 8/2002 | Umeda | 323/268 |
| 2007/0002596 | A1 | 1/2007 | Kenny et al. | |
| 2007/0252564 | A1 * | 11/2007 | De Nisi et al. | 323/268 |
| 2008/0150619 | A1 * | 6/2008 | Lesso et al. | 327/536 |

* cited by examiner

*Primary Examiner* — Harry Behm
(74) *Attorney, Agent, or Firm* — Schwegman, Lundberg & Woessner, P.A.

(57) ABSTRACT

This document discusses, among other things, a device for providing a DC output voltage, including a first output voltage and a second output voltage, from an input voltage. The device can include a first voltage regulator configured to provide the first output voltage when the input voltage is below a threshold voltage, and a charge pump configured to provide the second output voltage from the first output voltage in a two-state mode when the input voltage is below the threshold voltage, and to provide the first output voltage and the second output voltage in a three-state mode when the input voltage is above the threshold voltage.

19 Claims, 5 Drawing Sheets

SELECTIVELY ACTIVATED THREE-STATE CHARGE PUMP

BACKGROUND

Many direct current (DC) powered devices require a regulated DC power supply at a particular voltage or set of voltages for operation. Power sources such as alternating current (AC) line power or DC battery power, however, may not provide power that is sufficiently regulated for direct use by sensitive electronics. Moreover, many electronics operate at power levels different than those provided by the power sources.

To remedy this situation, voltage regulators can be used to convert power from a power source into regulated power of the proper voltage for a particular electronic device. In certain examples, a voltage regulator can be incorporated into a powered device, or can be a separate unit between the powered device and the power source. Many modern electronic devices use multiple voltage regulators to provide power at different levels for use by various components throughout the device.

A linear voltage regulator is one type of voltage regulator. Linear voltage regulators (also referred to herein as "linear regulators") can be used to convert a range of voltages above a desired voltage into the desired voltage, such as by passing the voltage through an active device (e.g. transistor) and burning off the "unwanted" voltage as heat. Although linear regulators can regulate output voltages with specificity and low ripple, linear regulators can have relatively low bandwidth compared to other voltage regulators.

Charge pumps are another mechanism used to convert an input voltage of a first level into an output voltage of a second level. Charge pumps can be used to generate an output voltage of a level that is increase or decrease an input voltage.

OVERVIEW

This document discusses, among other things, a device for providing a DC output voltage, including a first output voltage and a second output voltage, from an input voltage. In an example, the device can be configured to operate in a first configuration when the input voltage is below a threshold voltage and in a second configuration when the input voltage is above the threshold voltage. In the first configuration, a first voltage regulator can provide the first output voltage and a charge pump can provide the second output voltage. The charge pump can be configured to operate in a two-state mode to provide the second output voltage from the first output voltage. In the second configuration, the charge pump can be configured to operate in a three-state mode to provide both the first output voltage and the second output voltage.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present inventors have recognized, among other things, that the flexibility and simplicity of a linear regulator can be combined with an efficient and inexpensive, but in certain examples less flexible, charge pump to create a hybrid voltage regulator that can efficiently and inexpensively convert an input voltage into an output voltage. In certain examples, during generation of an output voltage, a less efficient linear regulator can be bypassed by a more efficient charge pump. In an example, the efficiency of a linear regulator can be based on a voltage drop between the input voltage and the output voltage. Accordingly, in certain examples, the linear voltage regulator can be bypassed when an input voltage is at a high voltage level relative to the output voltage.

In certain examples, when the difference between the input voltage and the output voltage is large, the output voltage can be provided by a charge pump, and when the difference between the input voltage and the output voltage is small, the output voltage can be provided by the linear regulator. A threshold voltage can be selected to determine when to provide the output voltage with the charge pump and when to provide the output voltage with the linear regulator. Additionally, in certain examples, a second linear regulator can be included. The second linear regulator can generate a stable input voltage for use by charge pump when the charge pump is generating the output voltage.

Figure 1:
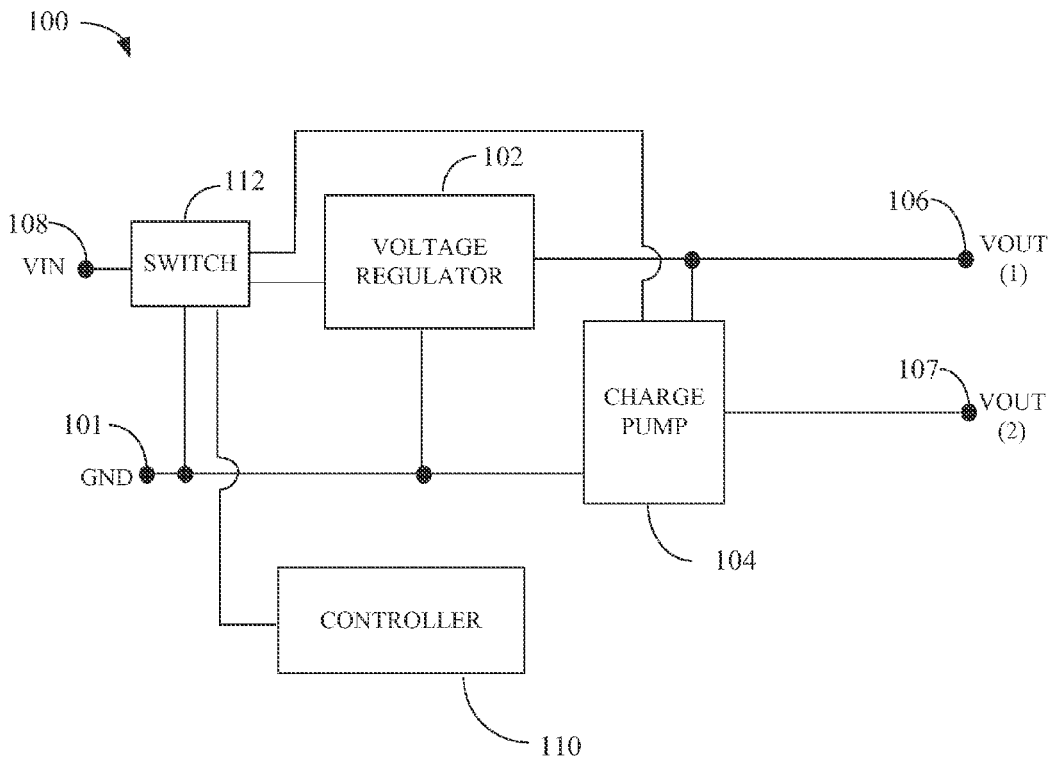
FIG. 1 illustrates generally an example of a circuit for providing a DC output voltage.

FIG. 1 illustrates generally an example of a circuit 100 configured to convert an input voltage 108 into a first DC output voltage 106 and a second DC output voltage 107. The circuit 100 of FIG. 1 includes a voltage regulator 102 that can provide the first DC output voltage 106 during certain conditions and a charge pump 104 that can provide the first DC output voltage 107 during other conditions. In an example, the circuit 100 can include a controller 110, or one or more other circuits (e.g., a comparator, etc.), configured to compare the input voltage 108 to a threshold voltage to determine when to provide the first output voltage 106 with the voltage regulator 102 and when to provide the second output voltage 107 with the charge pump 104. In certain examples, the second output voltage 107 can include the complement of the first output voltage 106.

In certain examples, the circuit 100 of FIG. 1 can operate as a DC-to-DC converter by converting a DC input voltage into the first and second DC output voltage 106, 107. In other examples, the circuit 100 of FIG. 1 can operate as an AC-to-DC converter by rectifying an AC input voltage 108 to provide the first and second DC output voltage 106, 107. In an example, the input voltage 108 can include a DC voltage of a higher level than the first output voltage 106, such that the circuit 100 of FIG. 1 can reduce the input voltage 108 to provide the first output voltage 106. In another example, the input voltage 108 can be lower than the first output voltage 106 such that the circuit 100 of FIG. 1 can increase the input voltage to provide the first output voltage 106. In yet other examples, the input voltage 108 can be higher than the first output voltage 106 for certain periods of time and lower than the first output voltage 106 for other periods of time (e.g., when the input voltage 108 is an AC voltage). In certain examples, the first output voltage 106 can be held constant over time (e.g. a regulated voltage).

The voltage regulator 102 can be coupled between a switching device 112 and the first output voltage 106. The voltage regulator 102 can also be coupled to a ground 101. In certain examples, the voltage regulator 102 can include a linear regulator. For instance, a linear regulator can be used to convert a higher input DC voltage 108 (e.g. +3.5 V) into a lower first output DC voltage 106 (e.g. +1.7 V). A linear regulator can also be used to half-wave rectify an AC input voltage 108 that has a higher magnitude than the first DC output voltage 106. In certain examples, the voltage regulator 104 can include a switching regulator.

In operation, the voltage regulator 102 can be used to provide the first output voltage 106 during certain conditions and the charge pump 104 can be used to provide the first output voltage 106 during other conditions. Whether the voltage regulator 102 or the charge pump 104 can provide the first output voltage 106 can be based on the difference between the input voltage 108 and the first output voltage 106. In certain examples the charge pump 104 can be used to provide the first output voltage 106 when the difference between the input voltage 108 and the first output voltage 106 is large. When the difference between the input voltage 108 and the first output voltage 106 is small, the voltage regulator 102 can be used to provide the first output voltage 106. Utilizing both the voltage regulator 106 and the charge pump 108 can enable the circuit 100 of FIG. 1 to efficiently provide DC output power from a variable input power. For instance, when the difference between the input voltage 108 and the first output voltage is large the voltage regulator 102 can be less efficient at providing the first output voltage 106 than charge pump 104.

In an example, a threshold voltage can be used to determine whether the voltage regulator 102 or the charge pump 104 can be used to generate the first output voltage 106. To control whether the first output voltage 106 can be provided by voltage regulator 102 or charge pump 104, the circuit 100 of FIG. 1 includes a controller 110 and the switching device 112. The switching device 112 can couple the input voltage 108 to either the voltage regulator 102 or the charge pump 104. The controller 110 can sense the input voltage 108, make a comparison based on the threshold voltage, and control the switching device 112 based on the comparison.

As referred to herein, the circuit 100 of FIG. 1 is in a first configuration when the switching device 112 is set to couple the input voltage 108 to the voltage regulator 102. Likewise, the circuit 100 of FIG. 1 is in a second configuration when the switching device 112 is set to couple the input voltage 108 to the charge pump 104.

In an example, the actual difference between the input voltage 108 and the output voltage 106 does not need to be determined. Accordingly, in certain examples, the threshold voltage can be compared directly to the input voltage 105. When the input voltage 108 is less than the threshold voltage, the circuit 100 of FIG. 1 can operate in the first configuration. When the input voltage 108 is greater than the threshold voltage, the circuit 100 of FIG. 1 can operate in the second configuration.

In an example, the threshold voltage can be compared to a difference between the input voltage 102 and the first output voltage 106. When the difference between the input voltage 108 and the first output voltage 106 is less than the threshold voltage the circuit 100 of FIG. 1 can be operated in the first configuration. When the difference between the input voltage 108 and the first output voltage 106 is greater than the threshold voltage, the circuit 100 of FIG. 1 can be set in the second configuration.

In an example, the controller 112 can compare the input voltage 108 to the threshold voltage to determine when to switch between the voltage regulator 102 and the charge pump 104. In other examples, however, the controller 112 can compare the threshold voltage to a difference between the input voltage 108 and the first output voltage 106 to determine when to switch the switching device 112.

In an example, the charge pump 108 can provide the second output voltage 107 regardless of whether the voltage regulator 102 or the charge pump 108 provided the first output voltage 106. The charge pump 108 can be coupled to the switching device 112, the first output voltage 106, the second output voltage 107, and ground 101.

In an example, the charge pump 104 can be configured to generate the second output voltage 107 using the first output voltage 106 generated by the voltage regulator 102. Thus, when the circuit 100 of FIG. 1 is in a first configuration where the switching device 112 is configured to couple the input voltage 108 to the voltage regulator 102, the voltage regulator 102 can convert the input voltage 108 into the first output voltage 106. In this first configuration, the charge pump 104 can then generate the second output voltage 107 using the first output voltage 108. When the circuit 100 of FIG. 1 is in a second configuration where the switching device 112 is configured to couple the input voltage 108 to the charge pump 104, the charge pump 104 can generate both the first and second output voltages 106, 107 from the input voltage 108.

When the circuit 100 of FIG. 1 is in the first configuration and the charge pump 104 is configured to generate the second output voltage 107 from the first output voltage 106, the charge pump 104 can be configured to operate in a two-state mode wherein the charge pump 104 can switch a flying capacitor between two states.

Figure 2:
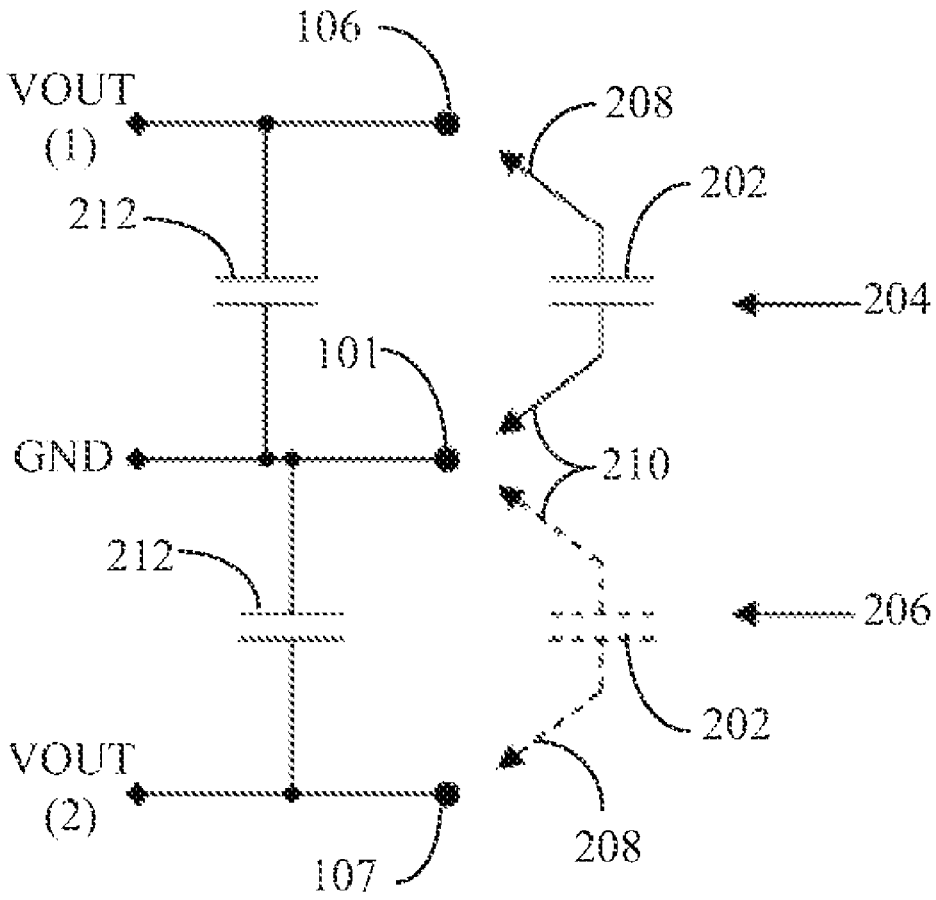
FIG. 2 illustrates generally an example of a flying capacitor for a charge pump in two-state mode.

FIG. 2 illustrates generally an example of the charge pump 104, including a flying capacitor 202, in a two-state mode. The two-state mode can include a first state 204 and a second state 206. In the first state 204 of the two-state mode, the flying capacitor 202 can be coupled between the first output voltage 106 and ground 101, such that a first side 208 of the flying capacitor 202 can be coupled to the first output voltage 106 and a second side 210 of the flying capacitor 202 can be coupled to ground 101. Accordingly, in the first state 204, the flying capacitor 202 can receive and store charge from the first output voltage 106. To provide the second output voltage 107, the flying capacitor 202 can be switched to a second state 206 of the two-state mode, where the flying capacitor 202 can be coupled to the second output voltage 107. Where the first and second sides 208, 210 of the flying capacitor 202 are coupled in the second state 206 can depend on the output voltage desired for the second output voltage 107. In an example, the second output voltage 107 can be the complement of the first output voltage 106, such that, in certain examples, the circuit 100 of FIG. 1 can provide complementary positive and negative DC power rails. In other examples, the second output voltage 107 can be different than the complement of the first output voltage 106. To provide positive and negative DC power rails, the flying capacitor 202 can be coupled between the second output voltage 107 and ground 101 in the second state 206 of the two-state mode, such that the first side 208 of the flying capacitor 202 that was coupled to the first output voltage 106 in the first state 204 of the two-state mode can be coupled to ground 101 in the second state 206. Likewise, the second side 210 of the flying capacitor 202 that was coupled to ground 101 in the first state 204 can be coupled to the second output voltage 107 in the second state 206 of the two-state mode. The amount of charge transferred by the flying capacitor 202 from the first state 204 to the second state 206 can depend on the length of time the flying capacitor 202 is coupled in each state. In certain examples, to generate a complement voltage at the second output voltage 107 from the first output voltage 106, the flying capacitor 202 can be coupled in the first state 204 of the two-state mode for approximately the same length of time that the flying capacitor 202 is coupled in the second state 206 of the two-state mode. In certain examples, however, the first and second sides 208, 210 of the flying capacitor 202 can be coupled differently in the first or second states 204, 206. Additionally, in certain examples, the flying capacitor 202 can be coupled in the first and second states 204, 206 for unequal lengths of time. The capacitors 212 can be fixedly coupled, such that, in certain examples, the capacitors 212 do not switch with the flying capacitor 202. In an example, the capacitors 212 can be configured to stabilize the first and second output voltages 106, 107. Accordingly, the capacitors 212 can be coupled between the first output voltage 106 and ground 101, or between ground 101 and the second output voltage 107, respectively.

Referring back to FIG. 1, when the circuit 100 of FIG. 1 is in the second configuration, the switching device 112 can couple the input voltage 108 to the charge pump 104, such that the charge pump 104 can convert the input voltage 104 into the first output voltage 106. In this second configuration, the charge pump 104 can also generate the second output voltage 107. To provide both the first output voltage 106 and the second output voltage 107 from the input voltage 108, the charge pump 104 can operate in a three-state mode where the flying capacitor 202 of the charge pump 104 can be coupled between three different states.

Figure 3:
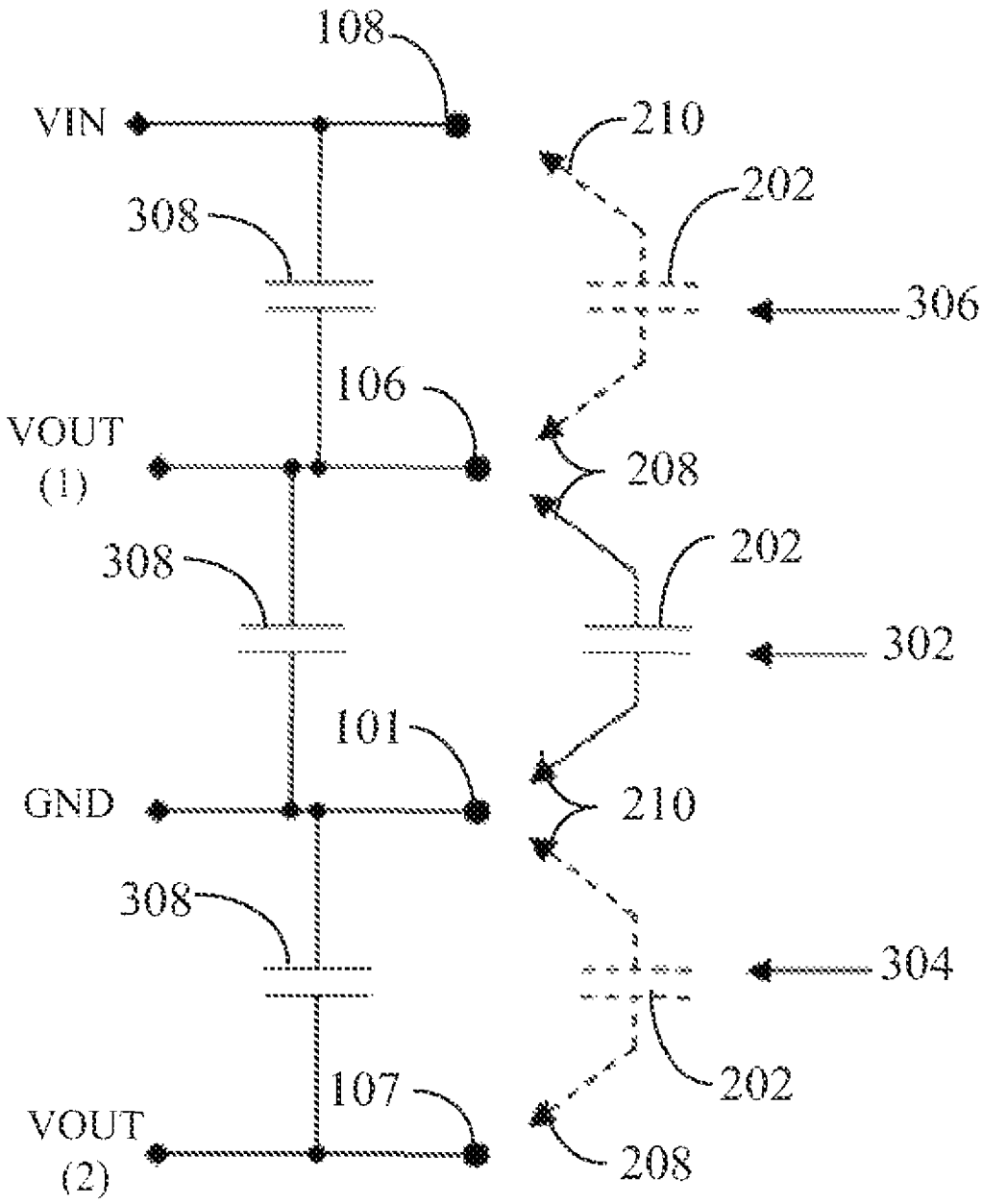
FIG. 3 illustrates generally an example of a flying capacitor for a charge pump in three-state mode.

FIG. 3 illustrates generally an example of the charge pump 104, including the flying capacitor 202, in a three-state mode. The first state 302 of the three-state mode can include the flying capacitor 202 coupled between the first output voltage 106 and ground 101. In the first state 302, a first side 208 of the flying capacitor 202 can be coupled to the first output voltage 106 and a second side 210 of the flying capacitor 202 can be coupled to ground 101. In the second state 304 of the three-state mode can include the flying capacitor 202 coupled between ground 101 and the second output voltage 107. In the example shown in FIG. 3, the flying capacitor 202 can be coupled in the second state 304 in an opposite direction as in the first state 302, such that in the second state 304 of the three-state mode, the first side 208 of the flying capacitor 202 can be coupled to ground 101 and the second side 210 of the flying capacitor 202 can be coupled to the second output voltage 107. Thus, similar to that shown in FIG. 2, in FIG. 3 the second output voltage 107 can be the complement of the first output voltage 106. In particular, the flying capacitor 202 can be coupled in the first state 302 and the second state 304 of the three-state mode for approximately equal lengths of time, such that the second output voltage 107 corresponds to a complement of the first output voltage 106. The third state 306 of the three-state mode shown in FIG. 3 can include the flying capacitor 202 coupled between the input voltage 108 and the first output voltage 106, such that the first side 208 of the flying capacitor 202 can be coupled to the input voltage 108 and the second side 210 of the flying capacitor 202 can be coupled to the first output voltage 106.

In addition to being coupled in the first state 302 for approximately the same length of time as the second state 304, in an example, the flying capacitor 202 is also coupled in the third state 306 for approximately the same length of time as the first state 302 or the second state 304. In an example, the flying capacitor 202 can be coupled in the first state 302, in the second state 304, and in the third state 306 for approximately the same lengths of time. In an example, the first output voltage 106 can be approximately half of the input voltage 108, and the second output voltage 107 can be the complement of the first output voltage 106. In other examples, the flying capacitor 202 can be coupled in one or more of the first state 302, the second state 304, or the third state 306 of the three-state mode for different amounts of time, depending on desired output voltages or one or more other factors.

In an example, the three-state mode can be explained mathematically. With a rapidly switching capacitor (e.g. the flying capacitor 202), the voltage across the capacitor should be constant across each state. Thus, with the flying capacitor 202 coupled in each of the three states of FIG. 3 for approximately the same length of time, the following holds true: V(capacitor 202)=V(input 108)−V($1^{st}$ output 106)=V($1^{st}$ output 106)−V(ground 101)=V(ground 101)−V($2^{nd}$ output 107). Accordingly, the first output voltage 106 can be approximately half of the input voltage 108 and the second output voltage 107 can be the complement of the first output voltage 106.

Additionally, in certain examples, the charge pump 104 can include variable state timing, such that charge pump 104 can provide stable voltages for the first output voltage 106 and the second output voltage 107 from a range of input voltages. For example, when the input voltage 108 is higher, the charge pump 104 can be coupled in the third state 306 for a shorter amount of time than when the input voltage 108 is lower. Thus, less charge can build up in the flying capacitor 202 and, in turn, less voltage can be transferred to the output voltages 106, 107. Similar to that discussed above with respect to FIG. 2, the capacitors 308 can be fixedly coupled, such that the capacitors 308 do not switch with flying capacitor 202. The capacitors 308 can be configured to stabilize the output voltages 106, 107. Accordingly, the capacitors 308 can be respectively coupled between the first output voltage 106 and ground 101, between ground 101 and the second output voltage 107, and between the input voltage 108 and the first output voltage 106.

In the examples shown in FIG. 2 and FIG. 3, the first and second states of the flying capacitor 202 can be the same in both the two-state mode and the three-state mode. Accordingly, when the circuit 100 of FIG. 1 is in the first configuration (the input voltage 108 coupled to the voltage regulator 102), the charge pump 108 can operate in a two-state mode. When circuit 100 of FIG. 1 is in the second configuration (the input voltage 108 coupled to the charge pump 104), the charge pump 104 can engage the third state and can operate in three-state mode. Thus, in the first configuration, where the voltage regulator 102 can generate the first output voltage 106, the charge pump 104 can operate in two-state mode to generate the second output voltage 107 from the first output voltage 106. In the second configuration, where the voltage regulator 102 is bypassed, the charge pump 104 can generate both the first and second output voltages 106, 107 by engaging the third state and operating in three-state mode.

Figure 4:
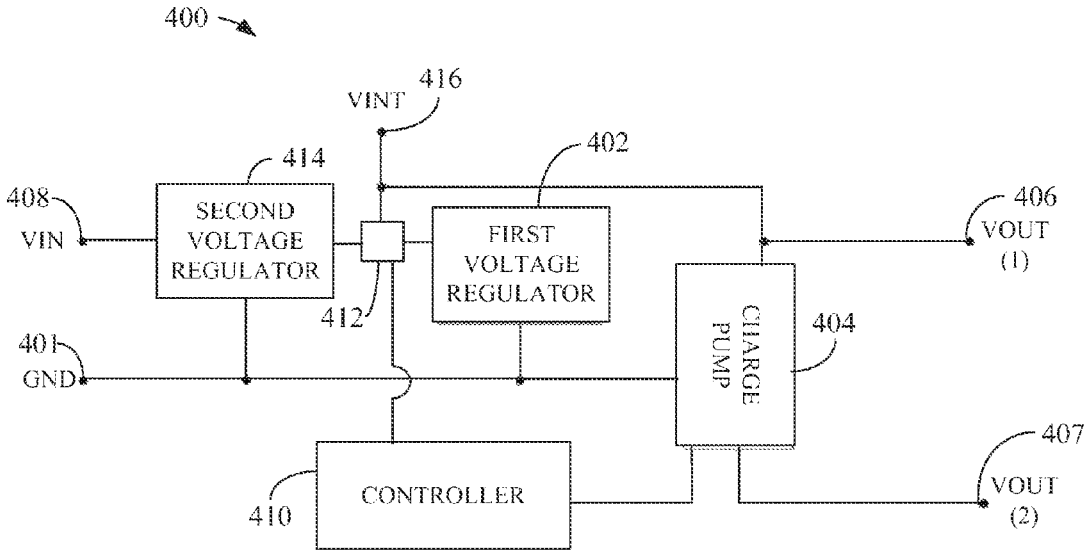
FIG. 4 illustrates generally an example of a circuit for providing a DC output charge.

FIG. 4 illustrates generally an example of a circuit 400 configured to provide DC output power from a variable input voltage. Similar to the circuit 100 of FIG. 1, the circuit 400 of FIG. 4 can include a first voltage regulator 402, a charge pump 404, a controller 410, and a switching device 412. In an example, the circuit 400 can include a second voltage regulator 414 configured to provide an intermediate voltage 416 to the switching device 412. The second voltage regulator 414 can convert an input voltage 408 to the intermediate voltage 416. In an example, the first voltage regulator 402 can be coupled between the switching device 412 and the first output voltage 406. In other examples, the first voltage regulator 402 can also be coupled to a ground 401. In an example, the second voltage regulator 414 can be coupled between input voltage 408 and the switching device 412. In other examples, the second voltage regulator 414 can also be coupled to ground 401. The charge pump 404 can be coupled to the switching device 412, the first output voltage 406, the second output voltage 408, and ground 401.

Similar to that described in circuit 100 of FIG. 1, the input voltage 408 can be higher or lower than a first output voltage 406, or the input voltage 408 can be higher than the first output voltage 406 for certain periods of time and lower than the first output voltage 406 for other periods of time. Also similar to that described in circuit 100 of FIG. 1, the first voltage regulator 402 and the second voltage regulator 414 can include a linear voltage regulator, a switching voltage regulator, or one or more other voltage regulators.

In converting the input voltage 408 to the intermediate voltage 416, the second voltage regulator 414 can generate a stable voltage for the intermediate voltage 416 from the variable input voltage 408. The second voltage regulator 414, therefore, can help reduce the complexity of the charge pump 404, because the charge pump 404 can generate the first output voltage 406 and the second output voltage 408 from a single stable voltage. Accordingly, in an example, the charge pump 404 can be configured to generate output voltages 106, 107 from a single input voltage level. In certain examples, however, the charge pump 404 can be configured to adjust for variable input voltages.

In operation, the switching device 412 can couple the intermediate voltage 416 to either the voltage regulator 402 (the first configuration of the circuit 400) or the charge pump 404 (the second configuration of the circuit 400). In certain examples, the controller 410 can control the switching device 412 based on a comparison of a threshold voltage similar to that described with respect to the circuit 100 of FIG. 1. In an example, the switching device 412 can set the circuit 400 of FIG. 4 in either the first or the second configuration.

In the first configuration, the switching device 412 can be set to couple the intermediate voltage 408 to the first voltage regulator 402. The voltage regulator 402 can convert the intermediate voltage 408 into the first output voltage 406. The controller 410, along with setting the switching device 412, can be configured to couple the intermediate voltage 408 to the first voltage regulator 402, or can set the charge pump 404 in a two-state mode. In the two-state mode, the charge pump 404 can generate the second output voltage 407 from the first output voltage 406.

In the second configuration, the switching device 412 can be set to couple the intermediate voltage 408 to the charge pump 404. The controller 410, along with setting the switching device 412 to couple the intermediate voltage 408 to the charge pump 404, can also set the charge pump 404 in a three-state mode. The charge pump 404 can convert the intermediate voltage into the first output voltage 406 and the second output voltage 407.

In certain examples, the first and second output voltage 406, 407 can include regulated voltages. Accordingly, the controller 410 can determine when to switch the switching device 412 based on the input voltage 408. In other examples, however, the controller 410 can determine when to switch the switching device 412 based on a difference between the input voltage 408 and the first output voltage 408.

In an example, the controller 410 can use a threshold voltage to determine when to switch the switching device 412. In an example, the threshold voltage can include a difference between the input voltage 408 and the first output voltage 406. When the difference is less than the threshold voltage the circuit 400 can be set in the first configuration. When the difference between the input voltage 408 and the first output voltage 406 is greater than the threshold voltage, the circuit 400 can be set in the second configuration. In certain examples, the first output voltage 406 can be regulated. When the first output voltage 406 is regulated, the threshold voltage can be compared directly to the input voltage 408 because the first output voltage 406 does not change substantially. In certain examples, therefore, when the input voltage 408 is less than the threshold voltage, the controller 410 can set the circuit 400 in a first configuration. When the input voltage 408 is greater than the threshold voltage, the controller 410 can set the circuit 400 in the second configuration.

In an example, the threshold voltage can be selected such that the second voltage regulator 414 is high enough that the second voltage regulator 414 can provide an intermediate voltage 416 that is double the desired first output voltage 406. For example, if the desired output voltage is 1.7 volts, the intermediate voltage can be set at double 1.7 V=3.4 volts. Thus, the threshold voltage level can be set to slightly higher than 3.4 volts to account for the voltage drop across second voltage regulator 414. The determination of the threshold voltage can also be applied when the threshold voltage is the difference between the input voltage 408 and the first output voltage 406.

In an example, the threshold voltage can be selected based on the drop out voltage of the second voltage regulator 414. For instance, the threshold can be set at the lowest input voltage 408 that the second voltage regulator 414 can convert into a sufficient intermediate voltage 416 for the charge pump 104. In an example, a sufficient intermediate voltage 416 for the charge pump 404 can include an intermediate voltage 416 that is double the first output voltage 406. Thus, in this example the threshold can be set at double the first output voltage 106 plus the minimum drop-out of the second voltage regulator 414. Accordingly, in certain examples, when the input voltage 408 drops below this threshold, the second voltage regulator 414 can no longer provide a sufficient intermediate voltage 416 for the charge pump 404. The controller 410, therefore, can set the switching device 412 to couple the intermediate voltage 416 to the first linear regulator 402. In addition, when the input voltage 408 drops below the level that the second linear regulator 414 can effectively provide the desired regulated intermediate voltage 416 (due to the required drop-out of second linear regulator 414), the second linear regulator 414 can enter a drop-out region. In the drop-out region, the second linear regulator 414 can function as a pass through device that simply passes through the input voltage 402 to the intermediate voltage 416 with minimal voltage loss.

Although in the examples described above, a single controller 410 is described to control the switching device 412 and the charge pump 404, in other examples, individual controllers can be used.

The three-state mode and two-state mode of the charge pump 404 can operate substantially as that described above with respect to FIG. 2 and FIG. 3, except that the voltage input to the charge pump 404 can include the intermediate voltage 416 instead of the input voltage 108 as illustrated in the example of FIG. 1. Additionally, in some examples, the first output voltage 406 and the second output voltage 407 can be complementary to each other, and the first output voltage 406 can be half of the intermediate voltage 416.

The present inventors have recognized that the circuits and methods described above can be used to combine the advantages of a linear regulator and a charge pump, while avoiding the disadvantages of each. For example, linear regulators can be less efficient when there is a large voltage drop across the linear regulator. Therefore, when there is a large voltage drop across the linear regulator, a charge pump can be used to provide the output voltage. The charge pump can provide the output voltage with high efficiency when there is a large drop across the charge pump. In certain examples, however, a complex charge pump circuit may be required in order to deal with varying input voltages. In an example, therefore, a second linear regulator can be provided to regulate the input voltage for the charge pump. Even with the second linear regulator, however, the efficiency of the circuit can be held high as a majority of the voltage drop between the input voltage and the output voltage is handled by the charge pump. The voltage drop across the second linear regulator, therefore, can be kept lower to improve the efficiency of the second linear regulator.

Figure 5:
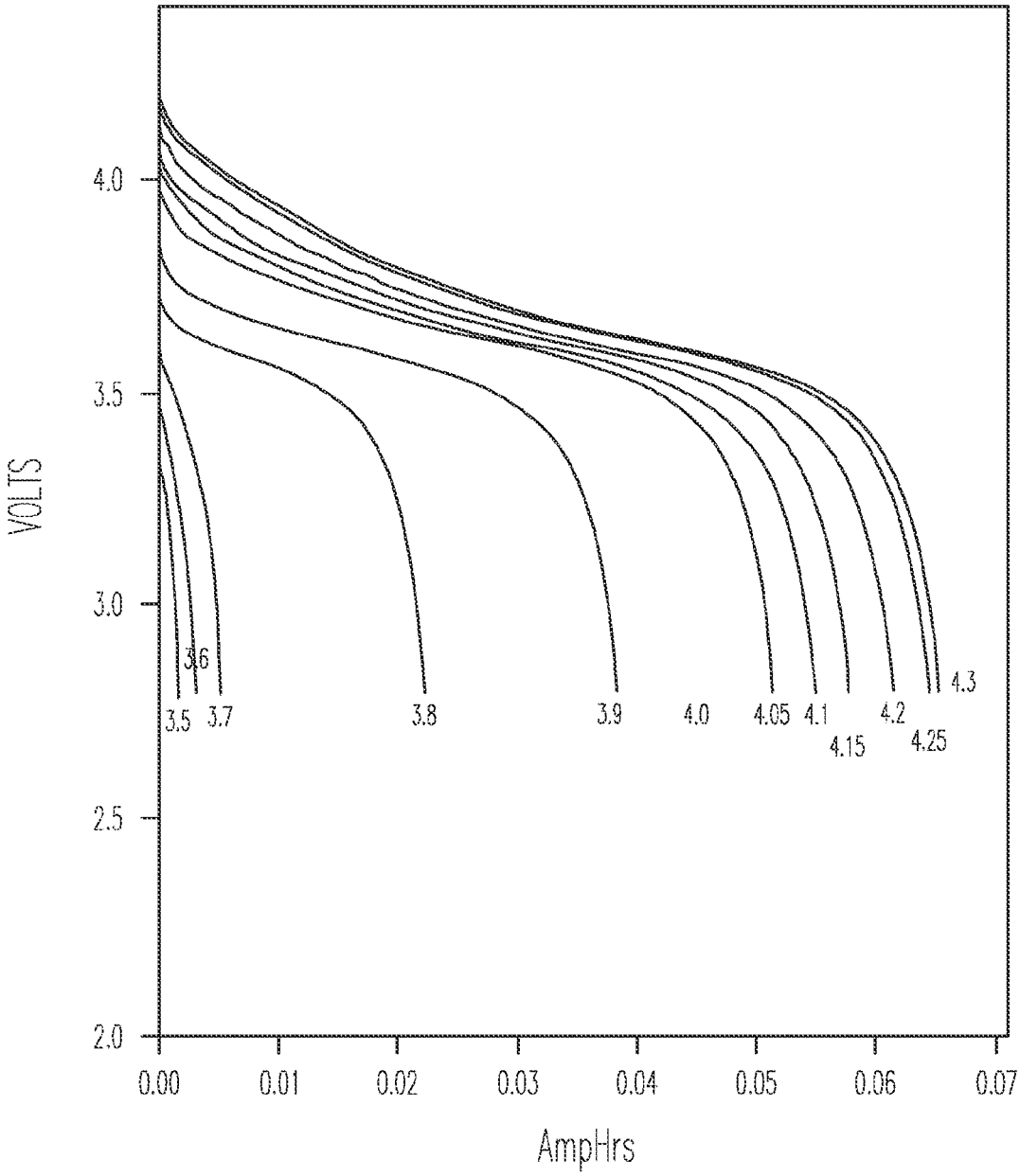
FIG. 5 illustrates generally an example of graph showing discharge cycles for a battery.

The present inventors have recognized that the circuits or examples described above can be particularly efficient in generating a regulated, step-down voltage from a battery. As an example, a typical lithium ion battery has discharge curves as shown in the graph 500 of FIG. 5. As shown by graph 500, the battery retains a charge above 3.4 volts for a majority of the discharge time. After the battery drops to a voltage of 3.4 volts, the battery quickly discharges to below 3 volts. Accordingly, in one example, the threshold for circuit 100 or 400 can be set at 3.4 volts. When the input voltage is above 3.4 volts, the charge pump 104, 404 can be used to generate the first output voltage 108, 408. When the input voltage is below 3.4 volts, the voltage regulator 102, 402 can be used to generate the first output voltage 108, 408. Since the majority of the discharge time of the battery is spent above 3.4 volts, the majority of the battery discharge can be converted to the first output voltage using the higher efficiency charge pump 104, 404. The lower efficiency voltage regulator 102, 402, can be used during the relatively short end portion of the battery discharge curve. In certain examples, other threshold voltages can be used to account for different battery voltages, output voltages, battery discharge curves or design criteria.

Additional Notes

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown and described. However, the present inventor also contemplates examples in which only those elements shown and described are provided.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

As used herein the terms "higher", "greater", "lower" and "less" with regards to voltage levels relate to the absolute value of a voltage relative to a ground voltage. For example, a +3 voltage is greater than a +2 voltage and a −3 voltage is greater than a −2 voltage.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, the code may be tangibly stored on one or more volatile or non-volatile computer-readable media during execution or at other times. These computer-readable media may include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

What is claimed is:

1. A device for providing a DC output voltage, including a first output voltage and a second output voltage, from an input voltage, the device comprising:

a first linear regulator configured to provide the first output voltage when the input voltage is below a threshold voltage; and a charge pump configured to provide the second output voltage from the first output voltage in a two-state mode when the input voltage is below the threshold voltage and to provide the first output voltage and the second output voltage in a three-state mode when the input voltage is above the threshold voltage.

2. The device of claim 1, wherein the first linear regulator is configured to convert the input voltage into the first output voltage when the input voltage is below a threshold voltage; and wherein the charge pump is configured to convert the input voltage into the first input voltage and the second output voltage when the input voltage is above the threshold voltage.

3. The device of claim 1, comprising a second linear regulator configured to convert the input voltage into an intermediate voltage, wherein the first linear regulator is configured to convert the intermediate voltage into the first output voltage when the input voltage is below a threshold voltage, and wherein the charge pump is configured to convert the intermediate voltage into the first input voltage and the second output voltage when the input voltage is above the threshold voltage.

4. The device of claim 3, wherein the first output voltage corresponds to half of the intermediate voltage, and wherein the second output voltage is complementary to the first output voltage.

5. The device of claim 3, wherein the input voltage is a variable DC voltage and the first linear regulator generates a stable DC voltage for the first and second output voltages.

6. The device of claim 1, wherein the charge pump includes a first state including a flying capacitor coupled between the first output voltage and a ground, a second state including the flying capacitor coupled between a ground and the second output voltage, and a third state including the flying capacitor coupled between the input voltage and the first output voltage.

7. The device of claim 6, wherein the charge pump is configured to switch between the first state and the second state in a two-state mode, and to switch between the first state, the second state, and the third state in a three-state mode.

8. A method of providing a DC output voltage, including a first output voltage and a second output voltage, from an input voltage, the method comprising:

providing the first output voltage using a first linear regulator when the input voltage is below a threshold voltage;

providing the second output voltage using a charge pump configured to operate in a two-state mode when the input voltage is below the threshold voltage; and providing the first output voltage and the second output voltage using the charge pump configured to operate in a three-state mode when the input voltage is above the threshold voltage.

9. The method of claim 8, wherein the providing the first output voltage using the first linear regulator includes converting the input voltage into the first output voltage using the first linear regulator; and wherein the providing the first output voltage using the charge pump includes converting the input voltage into the first output voltage using the charge pump.

10. The method of claim 8, comprising:

converting an input voltage into an intermediate voltage using a second linear regulator;

wherein the providing the first output voltage using the first linear regulator includes converting the intermediate voltage into the first output voltage using the first linear regulator; and wherein the providing the first output voltage using the charge pump includes converting the intermediate voltage into the first output voltage using the charge pump.

11. The method of claim 10, wherein the providing the first output voltage includes providing a first output voltage corresponding to half of the intermediate voltage, and wherein the providing the second output voltage is complementary to the first output voltage.

12. The method of claim 10, wherein the input voltage is a variable DC voltage and wherein converting includes providing stable DC voltages for the first and second output voltages.

13. The method of claim 8, wherein the providing the second output voltage using the charge pump includes coupling a flying capacitor between the first output voltage and a ground in a first state, and coupling the flying capacitor between a ground and the second output voltage in a second state; and wherein the providing the first output voltage and the second output voltage using the charge pump includes coupling the flying capacitor between the input voltage and the first output voltage in a third state.

14. The method of claim 13, wherein the providing the second output voltage using the charge pump includes operating in a two-state mode, switching the charge pump between the first state and the second state; and wherein the providing the first output voltage and the second output voltage using the charge pump includes operating in a three-state mode, switching between the first state, the second state, and the third state.

15. The method of claim 8, wherein the providing the first output voltage using the first linear regulator includes providing the first output voltage with a linear regulator.

16. A circuit for providing a stable DC output voltage including a first output voltage and a second output voltage, the circuit comprising:

a first linear regulator configured to convert an input voltage into an intermediate voltage;

a second linear regulator configured to convert the intermediate voltage into the first output voltage when the input voltage is below a threshold; and a charge pump configured to provide the second output voltage from the intermediate voltage in a two-state mode when the input voltage is below the threshold, and to provide the first output voltage and the second output voltage from the intermediate voltage in a three-state mode when the input voltage is above the threshold.

17. The circuit of claim 16, wherein the input voltage is a variable DC voltage and the first linear regulator generates a stable DC voltage from the input voltage.

18. The circuit of claim 17, wherein the first output voltage provided by the second linear regulator is a stable DC voltage.

19. The circuit of claim 16, comprising:

a switching mechanism configured to couple the intermediate voltage to the second linear regulator when the input voltage is below the threshold and to bypass the second linear regulator and couple the intermediate voltage to the charge pump when the input voltage is above the threshold.

* * * * *